US005139889A

United States Patent [19]

Imazu et al.

[11] Patent Number: 5,139,889

[45] Date of Patent: Aug. 18, 1992

[54] THICKNESS-REDUCED DRAW-FORMED CAN

[75] Inventors: Katsuhiro Imazu, Yokohama; Nobuyuki Sato, Ebina; Tomomi Kobayashi; Naoto Watanabe, both of Yokohama, all of Japan

[73] Assignee: Toyo Seikan Kaisha, Ltd., Tokyo, Japan

[21] Appl. No.: 676,488

[22] Filed: Mar. 28, 1991

[30] Foreign Application Priority Data

May 16, 1990 [JP] Japan ..... 2-124183

[51] Int. Cl.[5] ..... B65D 90/04; B32B 15/18; B32B 15/08

[52] U.S. Cl. ..... 428/626; 428/623; 428/472; 220/456

[58] Field of Search ..... 428/668, 654, 626, 622, 428/658, 659, 623, 472, 35.8; 220/455, 454, 456

[56] References Cited

U.S. PATENT DOCUMENTS 3,360,157 12/1967 Bolt et al. ..... 220/455
4,465,525 8/1984 Yoshimura et al. ..... 420/41
4,956,242 9/1990 Shimizu et al. ..... 428/606

*Primary Examiner*—Michael Lewis
*Assistant Examiner*—Valerie Lund
*Attorney, Agent, or Firm*—Sughrue, Mion, Zinn, Macpeak & Seas

[57] ABSTRACT

Disclosed is a thickness-reduced deep-draw-formed can, which is prepared by subjecting a resin-coated structure of a surface-treated steel plate comprising, as the substrate, a cold-rolled steel plate having a carbon content in the steel of 0.04 to 0.15% by weight and a manganese content in the steel of 0.3 to 1.0% by weight, an average crystal grain size not larger than 6.0 μm and a tensile strength of at least 65 kg/mm$^2$, to reduction of the thickness and deep-draw-forming.

This can has a high pressure-resistant vessel strength, a high uniformity of the can plate thickness, a high adhesion of the coating and a high corrosion resistance in combination.

12 Claims, 2 Drawing Sheets

THICKNESS-REDUCED DRAW-FORMED CAN

BACKGROUND OF THE INVENTION

1. Field of the Invention

The present invention relates to a thickness-reduced deep-draw-formed can prepared from a resin-coated surface-treated steel plate. More particularly, the present invention relates to a thickness-reduced deep-draw-formed can having a high pressure-resistant vessel strength, an excellent appearance, a high uniformity of the can plate thickness, a good coating adhesion and a high corrosion resistance in combination.

2. Description of the Related Art

As the conventional process for forming a side-seamless can, there has been known a process comprising forming a metal blank such as an aluminum plate, a tinplate or a tin-free steel plate into a cup having a barrel having no seam on the side face and a bottom integrally connected seamlessly to the barrel by subjecting the metal blank to drawing of at least one stage between a drawing die and a punch, and if desired ironing the barrel of the cup between an ironing punch and an ironing die to reduce the thickness of the barrel. It has also been known that in preparing this side-seamless can, a metal plate laminated with a film of a thermoplastic resin such as polypropylene or a thermoplastic polyester is used as the metal blank.

In Japanese Unexamined Patent Publication No. 01-258822, we have proposed a process for reducing the thickness of a side wall of a can by bending and elongation in the above-mentioned deep-draw-forming process, that is, a redrawing process comprising holding a preliminarily drawn cup of a coated metal plate by an annular holding member inserted into the cup and a redrawing die, and relatively moving the redrawing die and a redrawing punch arranged coaxially with the holding member and redrawing die in such a manner that the redrawing punch can come into the holding member and come out therefrom, so that the redrawing punch and redrawing die are meshed with each other, to thereby draw-form the preliminarily drawn cup into a deep-drawn cup having a diameter smaller than that of the preliminarily drawn cup, wherein the curvature radius (Rd) of the working portion of the redrawing die is 1 to 2.9 times the blank thickness (tB) of the metal plate and the curvature radius (Rd) of the holding corner portion of the holding member is 4.1 to 12 times the blank thickness (tB) of the metal plate, flat portions, engaging with the preliminarily drawn cup, of the holding member and redrawing die have a dynamic friction coefficient of 0.001 to 0.2, and draw-forming of at least one stage is carried out so that the redraw ratio, defined by the ratio of the diameter of the shallow-draw-formed cup to the diameter of the deep-draw-formed cup, is in the range of from 1.1 to 1.5, whereby the side wall of the cup is bent and thinned uniformly along the entire height thereof. Furthermore, use of a tin-free steel plate (electrolytically chromate-treated steel plate) coated with an epoxy paint as the coated metal plate has been proposed.

In the draw-redraw forming, plastic flow is caused so that the size of the coated metal plate is increased in the can height direction and is diminished in the circumferential direction of the can barrel. Accordingly, in the can barrel obtained by the draw-redraw forming, the thickness of the side wall tends to increase from the lower portion to the upper portion. In the above-mentioned conventional process for reducing the thickness by bending and elongation, an advantage is attained in that the thickness distribution is uniformalized in the vertical direction, but it has been found that if a surface-treated steel plate as heretofore used for the production of a draw-redraw-formed can is used in this process, problems arise with respect to the pressure-resistant vessel strength, the uniformity of the can plate thickness, the adhesion of the coating and the corrosion resistance.

From the viewpoint of the draw-formability, a cold-rolled steel plate having a high elongation, that is, a low-carbon steel plate, has heretofore been widely used as the surface-treated steel plate for a draw-redraw-formed can. However, in the case where a low-carbon steel plate is used for the production of a thickness-reduced draw-formed can, since the strength of the steel plate is low and the thickness of the side wall is reduced by bending and elongation, the pressure-resistant strength is insufficient. Furthermore, if a steel material having a high elongation is bent and elongated, conspicuous local elongation is readily caused, and by this local elongation, the vessel thickness is rendered uneven and such troubles as formation of pinholes, cracking and peeling are caused in the organic resin coating. As the result, reduction of the adhesion of the coating and exposure of the metal are caused, and the corrosion resistance of the can is drastically degraded.

SUMMARY OF THE INVENTION

It is therefore a primary object of the present invention to provide a thickness-reduced deep-draw-formed can, in which the above-mentioned defects of the conventional thickness-reduced deep-draw-formed can prepared from a resin-coated surface-treated steel plate are overcome, and which has a high pressure-resistant vessel strength, a high uniformity of the can plate thickness, a high adhesion of the coating and a high corrosion resistance in combination.

More specifically, in accordance with the present invention, there is provided a thickness-reduced deep-draw-formed can, which is prepared by subjecting a resin-coated structure of a surface-treated steel plate comprising, as the substrate, a cold-rolled steel plate having a carbon content in the steel of 0.04 to 0.15% by weight and a manganese content in the steel of 0.3 to 1.0% by weight, an average crystal grain size not larger than 6.0 μm and a tensile strength of at least 65 kg/mm$^2$, to reduction of the thickness and deep-draw-forming.

DETAILED DESCRIPTION OF THE INVENTION

Figure 1:
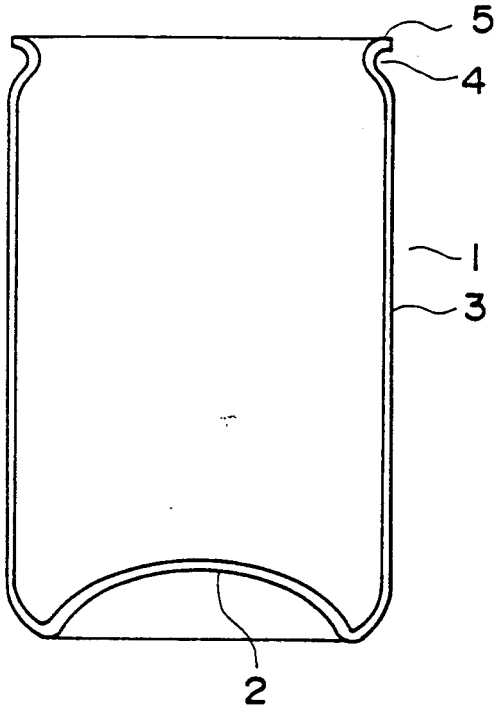
FIG. 1 is a diagram illustrating an example of the thickness-reduced deep-draw-formed can of the present invention.

The first characteristic feature of the present invention resides in that a surface-treated steel plate comprising, as the substrate, a cold-rolled steel plate having a carbon content in the steel of 0.04 to 0.15% by weight, especially 0.08 to 0.12% by weight, and a manganese content in the steel of 0.3 to 1.0% by weight, especially 0.5 to 0.8% by weight, is used. In the conventional draw-redraw forming process, a low-carbon steel plate is mainly used. In contrast, in the present invention, a high-carbon steel plate is used.

This high-carbon steel plate has such a high tensile strength as at least 65 kg/mm$^2$, especially 65 to 80 kg/mm$^2$. A high-carbon steel plate of a thin gauge is used as the blank, and even if the thickness is further reduced by bending and elongation at the deep-draw-forming step, there can be obtained a thickness-reduced deep-draw-formed can having a sufficient pressure-resistant strength to a content having a spontaneous pressure, such as a carbonated drink. Furthermore, although the elongation (tensile elongation at break) of this high-carbon steel plate is as low as less than 4.0%, especially 0.5 to 3.0%, according to the bending-elongation operation at the deep-draw-forming step of the present invention, the thickness of the side wall of the vessel can be considerably reduced. This is quite a surprising finding. In the high-carbon steel plate used in the present invention, since the elongation is very low as mentioned above, the local elongation is extremely small and therefore, formation of pinholes, cracking or peeling is not caused in the organic resin coating, and the adhesion or coverage of the coating is improved. Accordingly, a thickness-reduced deep-draw-formed can having an excellent corrosion resistance can be obtained.

In the cold-rolled steel plate, if the carbon content is below the above-mentioned range, the above-mentioned functional effects cannot be attained, and if the carbon content exceeds the above-mentioned range, the workability is reduced and it becomes difficult to perform redrawing or bending-elongation at the redrawing step. If the manganese content is below the above-mentioned range, a required pressure resistance cannot be attained, and if the manganese content exceeds the above-mentioned range, the steel plate becomes brittle and the plate fails to resist the processing of the present invention.

In view of the appearance characteristics, the adhesion of the coating and the prevention of the metal exposure, in the cold-rolled steel plate, it is important that crystal grains should be so fine that the average crystal grain size is not larger than 6.0 μm, especially 3.0 to 6.0 μm. If the average crystal grain size exceeds the above-mentioned range, longitudinal elongation is caused by drawing-redrawing deformation or monoaxial deformation (in the axial direction of the can) by bending-elongation, and therefore, surface roughening is caused, with the result that the appearance of the formed can is degraded, or insufficient adhesion of the coating or exposure of the metal is readily caused. According to the present invention, by using a cold-rolled high-carbon steel plate having an average crystal grain size not larger than 6.0 μm, these defects are eliminated and the appearance characteristics and corrosion resistance of the thickness-reduced deep-draw-formed can are prominently improved.

Referring to FIG. 1 illustrating an example of the thickness-reduced deep-draw-formed can of the present invention, this deep-draw-formed can 1 is prepared by deep-draw-forming (draw-redrawing) an organic resin-coated surface-treated steel plate and comprises a bottom 2 and a side wall 3. If desired, a flange 5 is formed on the top end of the side wall 3 through a neck portion 4. In this can 1, in general, the thickness of the side wall 3 is reduced by bending-elongation, as compared with the thickness of the bottom 2.

Figure 2:
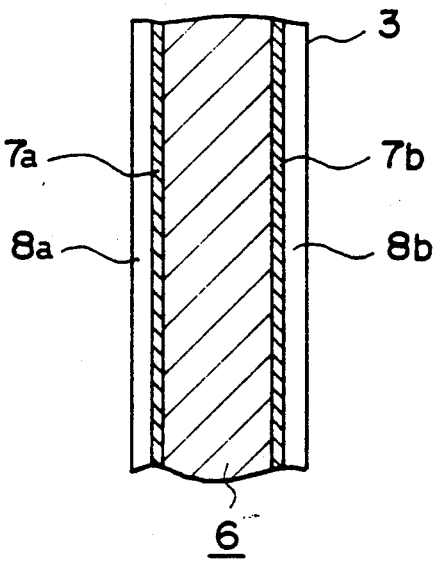
FIG. 2 is a sectional view illustrating an example of the coated metal plate preferably used in the present invention.

Referring to FIG. 2 illustrating an example of the sectional structure of the side wall 3, this side wall 3 comprises a cold-rolled high-carbon steel plate substrate 6, surface treatment layers 7*a* and 7*b* present on the surface of the substrate 6, and organic resin coatings 8*a* and 8*b* bonded closely through the surface treatment layers 7*a* and 7*b*. The sectional structure of the bottom 2 is substantially the same as the sectional structure of the side wall 3 except that the entire thickness of the bottom is some what larger than that of the barrel and the monoaxial orientation of the metal and resin seen in the side wall 3 is not present.

The cold-rolled high-carbon steel plate substrate 6 has a composition resembling that of a steel plate heretofore used for a can lid or the like for which a high-degree processing deformation is not necessary, but the steel plate substrate 6 is different from the conventional steel plate in that the strength is increased to a level of at least 65 kg/mm$^2$ by conducting rolling at least two times and the average crystal grain size is controlled below 6.0 μm. This steel plate is prepared by performing first rolling at a rolling reduction ratio of 70 to 90% and second rolling at a rolling reduction ratio of 20 to 50%. In order to control the average crystal grain size below 6.0 μm, the hot coil temperature before the rolling is adjusted to a level lower than the conventional temperature, for example, to a level of 980 to 1050° C., and intermediate annealing in the rolling process is carried out under milder conditions than in the conventional process (for example, intermediate annealing is carried out at a temperature of 650 to 700° C. for 30 to 60 seconds). The thickness of this cold-rolled high-carbon steel plate is preferably 0.05 to 0.35 mm, especially preferably 0.07 to 0.30 mm, though the preferred thickness somewhat depends on the dimensions of the final can and other conditions.

In order to maintain a good processability to the doming operation conducted on the bottom for imparting a high pressure-resistant strength and also maintain a sufficient pressure-resistant strength, it is preferred that the Erichsen value of the cold-rolled high-carbon steel plate used in the present invention be 2.5 to 7.0 mm, especially 3.0 to 6.0 mm.

In order to bring into uniformity the plate thickness in the circumferential direction after reduction of the thickness and draw forming and maintain a good formability stably at the subsequent necking step, it is preferred that the edge height be such that at the drawing operation conducted, for example, at a draw ratio of 1.75, the difference between the peak and trough is smaller than 4.00 mm, especially smaller than 3.0 mm.

As the surface treatment layer 7, there can be mentioned a layer formed by carrying out at least one surface treatment selected from a zinc deposition treatment, a tin deposition treatment, a nickel deposition treatment, an electrolytic chromate treatment and a chromate treatment. A preferred example of the surface-treated steel plate is an electrolytically chromate-treated steel plate, especially one comprising 10 to 200 mg/m$^2$ of a metallic chromium layer and 1 to 50 mg/m$^2$ (as calculated as the metallic chromium) of a chromium oxide layer. This surface treatment layer is excellent in the combination of the adhesion of the coating and the corrosion resistance. Another preferred example is a hard tinplate having a deposited tin amount of 0.5 to 11.2 g/m$^2$, and it is preferred that the tinplate be subjected to a chromate treatment or a chromate/phosphate treatment so that the deposited chromate amount is 1 to 30 mg/m$^2$ as calculated as metallic chromium. Still another example of the surface-treated steel plate is an aluminum-covered steel plate formed by deposition of aluminium or cladding of aluminium.

As the organic resin coating 8, there can be mentioned various thermoplastic resin films and thermosetting and thermoplastic resin coatings. As the film, there can be mentioned films of olefin resins such as polyethylene, polypropylene, an ethylene/propylene copolymer, an ethylene/vinyl acetate copolymer, an ethylene/acrylic ester copolymer and an ionomer, films of polyesters such as polyethylene terephthalate, polybutylene terephthalate, an ethylene terephthalate/isophthalate copolymer, an ethylene terephthalate/adipate copolymer, an ethylene terephthalate/sebacate copolymer and a butylene terephthalate/isophthalate copolymer, films of polyamides such as nylon 6, nylon 6,6, nylon 11 and nylon 12, and films of polyvinyl chloride and polyvinylidene chloride. These films can be undrawn films or biaxially drawn films. It is preferred that the film thickness be 3 to 50 μm, especially 5 to 40 μm.

Lamination of the film onto the metal plate is carried out by heat fusion bonding, dry lamination or extrusion coating. In the case where the adhesiveness (heat fusion bondability) is poor between the film and metal plate, a urethane adhesive, an epoxy adhesive, an acid-modified olefin resin adhesive, a copolyamide adhesive, a copolyester adhesive or an adhesive primer described below is interposed between them. A paint having an excellent adhesion to the metal plate, a high corrosion resistance and an excellent adhesion to the resin film is used as the adhesive primer. As the adhesive primer, there can be used a paint comprising an epoxy resin and a curing agent resin for the epoxy resin, such as a phenolic resin, an amino resin, an acrylic resin or a vinyl resin, especially an epoxy-phenolic resin, and an organosol paint comprising a vinyl chloride copolymer resin and an epoxy resin. The thickness of the adhesive primer or adhesive layer is preferably 0.1 to 5 μm.

At the lamination, a layer of the adhesive primer or adhesive is formed on one or both of the metal plate and the resin film, and after drying or partial curing is conducted according to need, both are heated, pressbonded and integrated. It sometimes happens that the biaxial molecular orientation in the film is somewhat moderated during the laminating operation, but this moderation has no influence on draw-redraw forming and sometimes, the forming workability is preferably improved by this moderation.

An inorganic filler (pigment) can be incorporated into the outer surface film used in the present invention so as to hide the metal plate and assist the transmission of the blank holding force to the metal plate at the draw-redraw forming. As the inorganic filler, there can be used inorganic white pigments such as rutile titanium dioxide, anatase titanium dioxide, zinc flower and gloss white, white extender pigments such as baryta, precipitated baryta sulfate, calcium carbonate, gypsum, precipitated silica, aerosil, talc, calcined or uncalcined clay, barium carbonate, alumina white, synthetic or natural mica, synthetic calcium silicate and magnesium carbonate, black pigments such as carbon black and magnetite, red pigments such as red iron oxide, yellow pigments such as sienna, and blue pigments such as ultramarine and cobalt blue. The inorganic filler can be incorporated in an amount of 10 to 500% by weight, especially 10 to 300% by weight, based on the resin.

Optional protecting paints composed of thermosetting or thermoplastic resins can be used instead of the film or together with the film. For example, there can be mentioned modified epoxy resins such as a phenol-epoxy resin and an amino-epoxy resin, vinyl or modified vinyl paints such as a vinyl chloride/vinyl acetate copolymer, a saponified vinyl chloride/vinyl acetate copolymer, a vinyl chloride/vinyl acetate/maleic anhydride copolymer, an epoxy-modified vinyl paint, an epoxyamino-modified vinyl paint and an epoxyphenol-modified vinyl paint, acrylic resin paints, and synthetic rubber paints such as a styrene/butadiene copolymer. These paints can be used singly or in the form of mixture of two or more of them.

The protecting paint can be used in the form of an organic solvent solution such as an enamel or lacquer or in the form of an aqueous dispersion or aqueous solution and applied to the metal blank by roller coating, spray coating, dip coating, electrostatic coating or electrophoretic coating. Of course, when the resin paint is thermosetting, the paint is baked according to need. In view of the corrosion resistance and workability, it is preferred that the thickness (dry state) of the protecting coating be 2 to 30 μm, especially 3 to 20 μm. A lubricant can be incorporated in the coating so as to improve the adaptability to the draw-redrawing operation.

Figure 3:
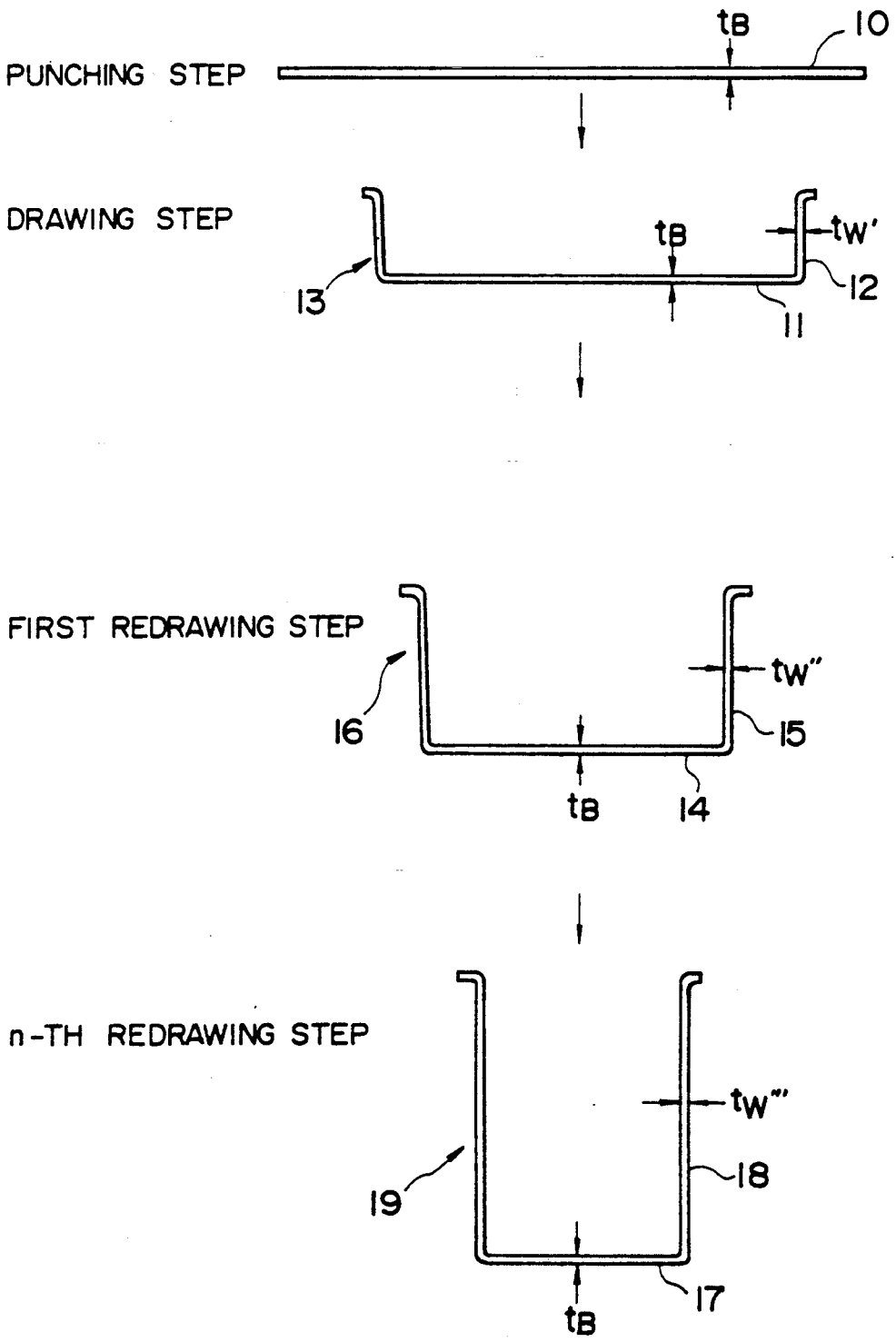
FIG. 3 is a sectional view illustrating the forming process according to the present invention.

Referring to FIG. 3 showing the draw-redrawing operation, a coated metal plate 10 is punched into a disk, and at a preliminary drawing step, the disk is formed into a preliminarily drawn cup 13 comprising a bottom 11 and a side wall 12 by using a preliminarily drawing punch and die having a large diameter. This preliminarily drawn cup is held by an annular holding member (not shown) inserted into the cup and a redrawing die (not shown), and the redrawing die and a redrawing punch arranged coaxially with the holding member and redrawing die are relatively moved so that the redrawing punch and redrawing die are meshed with each other, whereby a deep-draw-formed cup 16 having a diameter smaller than that of the preliminarily drawn cup is prepared by the draw forming. Similarly, the cup 16 is draw-formed into a cup 19 having a smaller diameter.

Reference numbers 14 and 17 represent bottoms of the cups 16 and 19, respectively, and reference numerals 15 and 18 represent side walls of the cups 16 and 19, respectively.

At this redraw forming, it is preferred that the thickness be reduced by bending and elongation at the working corner of the redrawing die, and at this redraw forming, it also is preferred that the thickness be reduced by applying light ironing to the coated metal plate between the redrawing punch and redrawing die.

Referring to FIG. 3, the following thickness relation is established among side walls of the respective cups:

$$tw''' \leqq tw'' \leqq tw' \leqq tB \quad (1)$$

It is preferred that the draw ratio defined by the following formula:

$$\text{Draw ratio} = \frac{\text{blank diameter}}{\text{punch diameter}} \quad (2)$$

be form 1.2 to 2.0, especially from 1.3 to 1.9, and that the redraw ratio defined by the following formula:

$$\text{Redraw ratio} = \frac{\text{diameter of drawing punch}}{\text{diameter of redrawing punch}} \quad (3)$$

be from 1.1 to 1.6, especially from 1.15 to 1.5. It also is preferred that the degree of reduction of the thickness of the side wall be 5 to 45%, especially about 5 to about 40%, based on the blank thickness (bottom thickness). Preferably, such conditions as causing molecular orientation in the resin layer are adopted for the draw-redraw forming. For this purpose, the draw-redraw forming is preferably carried out at the drawing temperature of the resin layer, for example, at 40 to 200° C. in case of PET.

The draw forming or redraw forming can be carried out by coating a lubricant such as liquid paraffin, synthetic paraffin, edible oil, hydrogenated edible oil, palm oil, a natural wax or polyethylene wax on the coated metal plate or cup. The amount coated of the lubricant is changed according to the kind of the lubricant, but it is generally preferred that the lubricant be coated in an amount of 0.1 to 10 mg/dm$^2$, especially 0.2 to 5 mg/dm$^2$. Coating of the lubricant is accomplished by spraying the lubricant in a melted state on the surface of the plate or cup.

The obtained deep-draw-formed cup is directly subjected to post treatments such as water washing and drying and is then subjected to doming, trimming, necking, beading and flanging to obtain a final can barrel.

As is apparent from the foregoing description, according to the present invention, by using a surface-treated steel plate comprising, as the substrate, a cold-rolled steel plate having a carbon content in the steel of 0.04 to 0.15% by weight and a manganese content in the steel of 0.3 to 1.0% by weight, an average crystal grain size not larger than 6.0 μm and a tensile strength of at least 65 kg/mm$^2$, subjecting this surface-treated steel plate in a state coated with an organic resin to draw-redraw forming (deep-draw-forming) and effecting bending-elongation at the redrawing step, there can be provided a thickness-reduced deep-draw-formed can having an excellent pressure-resistant vessel strength, an excellent appearance, a high uniformity of the can plate thickness, a high adhesion of the coating and a high corrosion resistance in combination. This can is valuable as a pressure-resistant can for containing beer or carbonated drink, a can for containing an ordinary drink or an ordinary food-packaging can.

EXAMPLES

The present invention will now be described in detail with reference to the following examples that by no means limit the scope of the invention.

EXAMPLE 1

A surface-treated steel plate was prepared by forming 150 mg/m$^2$ of a metallic chromium layer and 20 mg/m$^2$ of a chromium oxide layer as the surface treatment layer on a cold-rolled steel plate having a carbon content (C) in the steel of 0.12% by weight, a manganese content (Mn) in the steel of 0.55% by weight, an average crystal grain size of 3.55 μm, a tensile strength of 78% kg/mm$^2$, an elongation of 1.2%, an Erichsen value of 3.5 mm, an edge height of 2.5 mm and a blank thickness of 0.15 mm.

A polyethylene terephthalate/isophthalate copolymer film having a thickness of 20 μm was heat-bonded to both the surfaces of the surface-treated steel plate to obtain a resin-coated steel plate. Palm oil was coated on the resin-coated steel plate, and the steel pate was punched into a disk having a diameter of 187 mm and the disk was formed into a shallow-draw-formed can according to customary procedures. The draw ratio at this drawing step was 1.4.

At subsequent first, second and third redrawing steps, the draw-formed cup was preliminarily heated at 80° C., and redraw forming was carried out. The following conditions were adopted at the first to third redrawing steps.

First redraw ratio: 1.25
Second redraw ratio: 1.25
Third redraw ratio: 1.25
Curvature radius (Rd) of working corner of redrawing die: 0.40 mm The properties of the deep-draw-formed can obtained by the above redraw forming were as follows.

Cup diameter: 66 mm
Cup height: 140 mm
Thickness change ratio of side wall: 20%

Then, doming was carried out according to customary procedures, palm oil was removed by water washing, and trimming was carried out. Then, the cup was subjected to necking and flanging to obtain a thickness-reduced deep-draw-formed can.

The results of the tests of evaluation of formability, pressure resistance and corrosion resistance are shown in Table 1. As is seen from the results shown in Table 1, a thickness-reduced deep-draw-formed can excellent in not only formability but also pressure resistance and corrosion resistance was obtained.

EXAMPLE 2

A thickness-reduced deep-draw-formed can was prepared in the same manner as described in Example 1 except that a cold-rolled steel plate having a carbon content (C) in the steel of 0.09% by weight, a manganese content (Mn) in the steel of 0.70% by weight, an average crystal grain size of 4.2 μm, a tensile strength of 75 kg/mm$^2$, an elongation of 1.2%, an Erichsen value of 3.7 mm and an edge height of 1.3 mm was used instead of the cold-rolled steel plate used in Example 1.

The obtained results are shown in Table 1. As is seen from the results shown in Table 1, a thickness-reduced can having excellent formability, pressure resistance and corrosion resistance was obtained.

EXAMPLE 3

A thickness-reduced deep-draw-formed can was prepared in the same manner as described in Example 1 except that a cold-rolled steel plate having a carbon content (C) in the steel of 0.06% by weight, a manganese content (Mn) in the steel of 0.45 % by weight, an average crystal grain size of 5.9 μm, a tensile strength of 68 kg/mm$^2$, an elongation of 2.3%, an Erichsen value of 4.2 mm and an edge height of 3.0 mm was used instead of the cold-rolled steel plate used in Example 1.

The obtained results are shown in Table 1. As is seen from the results shown in Table 1, a thickness-reduced can having excellent formability, pressure resistance and corrosion resistance was obtained.

EXAMPLE 4

A thickness-reduced deep-draw-formed can was prepared in the same manner as described in Example 1 except that a cold-rolled steel plate having a carbon content (C) in the steel of 0.14% by weight, a manganese content (Mn) in the steel of 0.92% by weight, an average crystal grain size of 3.5 μm, a tensile strength of 82 kg/mm², an elongation of 0.5%, an Erichsen value of 3.0 mm and an edge height of 2.8 mm was used instead of the cold-rolled steel plate used in Example 1.

The obtained results are shown in Table 1. As is seen from the results shown in Table 1, a thickness-reduced can having a excellent formability, pressure resistance and corrosion resistance was obtained.

COMPARATIVE EXAMPLE 1

A thickness-reduced deep-draw-formed can was prepared in the same manner as described in Example 1 except that a cold-rolled steel plate having a carbon content (C) in the steel of 0.01% by weight, a manganese content (Mn) in the steel of 0.22% by weight, an average crystal grain size of 8.5 μm, a tensile strength of 58 kg/mm², an elongation of 4.5%, an Erichsen value of 6.2 mm and an edge height of 3.8 mm was used instead of the cold-rolled steel plate used in Example 1.

The obtained results are shown in Table 1.

During the forming operation, conspicuous surface roughening was caused on the cold-rolled steel plate and the resin coating, and the pressure-resistant strength was insufficient. Furthermore, the corrosion resistance was poor and leakage was often caused. Accordingly, it was confirmed that the obtained can was not suitable as a vessel.

COMPARATIVE EXAMPLE 2

A thickness-reduced deep-draw-formed can was prepared in the same manner as described in Example 1 except that a cold-rolled steel plate having a carbon content that a cold-rolled steel plate having a carbon content (C) in the steel of 0.05% by weight, a manganese content (Mn) in the steel of 0.30% by weight, an average crystal grain size of 6.8 μm, a tensile strength of 66 kg/mm², an elongation of 4.2%, an Erichsen value of 5.7 mm and an edge height of 3.5 mm was used instead of the cold-rolled steel plate used in Example 1.

The obtained results are shown in Table 1. The obtained can was poor in formability and corrosion resistance, and the can was not suitable as a vessel.

COMPARATIVE EXAMPLE 3

The preparation of a thickness-reduced deep-draw-formed can was tried in the same manner as described in Example 1 except that the carbon content (C) in the steel was changed to 0.17% by weight, the manganese content (Mn) in the steel was changed to 0.45% by weight, the average crystal grain size was changed to 3.6 μm, the tensile strength was changed to 78 kg/mm², the elongation was changed to 0.3% and the Erichsen value was changed to 2.1 mm.

The obtained results are shown in Table 1. As is seen from the results shown in Table 1, formability was very poor, and the steel plate was not suitable for the thickness-reducing deep-draw-forming.

COMPARATIVE EXAMPLE 4

The preparation of a thickness-reduced deep-draw-formed can was tried in the same manner as described in Example 1 except that the carbon content (C) in the steel was changed to 0.15% by weight, the manganese content (Mn) in the steel was changed to 1.10% by weight, the average crystal grain size was changed to 4.0 μm, the tensile strength was changed to 80 kg/mm², the elongation was changed to 0.1% and the Erichsen value was changed to 1.9 mm.

The obtained results are shown in Table 1. As is seen from the results shown in Table 1, formability was very poor, and the steel plate was not suitable for the thickness-reducing deep-draw-forming.

TABLE 1

| | C content (%) | Mn content (%) | Average crystal grain size (μm) | Tensile strength (Kg/mm²) | Elongation (%) | Erichsen value (mm) | Edge height difference (mm) | Formability | Pressure-resistant strength (kg/cm²) of bottom | Cola-preserving test (37° C., 6 months) state of corrosion of inner surface of can | Cola-preserving test (37° C., 6 months) number of leaked can (N = 100) |
|---|---|---|---|---|---|---|---|---|---|---|---|
| Example No. | | | | | | | | | | | |
| 1 | 0.12 | 0.55 | 3.55 | 78 | 1.2 | 3.5 | 2.5 | good | 7.2 | very good | 0 |
| 2 | 0.09 | 0.70 | 4.2 | 75 | 1.2 | 3.7 | 1.3 | good | 7.0 | very good | 0 |
| 3 | 0.06 | 0.45 | 5.9 | 68 | 2.3 | 4.2 | 3.0 | good | 6.5 | good | 0 |
| 4 | 0.14 | 0.92 | 3.5 | 82 | 0.5 | 3.0 | 2.8 | good | 7.2 | good | 0 |
| Comparative Example No. | | | | | | | | | | | |
| 1 | 0.01 | 0.22 | 8.5 | 58 | 4.5 | 6.2 | 3.8 | conspicuous surface roughening | 5.6 | corrosion at neck portion | 26 |
| 2 | 0.05 | 0.30 | 6.8 | 66 | 4.2 | 5.7 | 3.5 | conspicuous surface roughening | 6.3 | corrosion at neck portion | 8 |
| 3 | 0.17 | 0.45 | 3.6 | 78 | 0.3 | 2.1 | — | breaking of barrel | — | — | — |
| 4 | 0.15 | 1.10 | 4.0 | 80 | 0.1 | 1.9 | — | breaking of barrel | — | — | — |

We claim:

1. A thickness-reduced deep-draw-formed can, which is prepared by subjecting a resin-coated structure of a surface-treated steel plate comprising, as the substrate, a cold-rolled steel plate having a carbon content in the steel of 0.04 to 0.15% by weight and a manganese content in the steel of 0.3 to 1.0% by weight, an average crystal grain size not larger than 6.0 μm and a tensile strength of from 65 to 80 kg/mm², to reduction of the thickness and deep-draw-forming.

2. A thickness-reduced deep-draw-formed can as set forth in claim 1, wherein the carbon content in the steel is 0.08 to 0.12% by weight.

3. A thickness-reduced deep-draw-formed can as set forth in claim 1, wherein the manganese content in the steel is 0.5 to 0.8% by weight.

4. A thickness-reduced deep-draw-formed can as set forth in claim 1, wherein the average crystal grain size is 3.0 to 6.0 μm.

5. A thickness-reduced deep-draw-formed can as set forth in claim 1, wherein the thickness of the cold-rolled steel plate is 0.05 to 0.35 mm.

6. A thickness-reduced deep-draw-formed can as set forth in claim 1, wherein the Erichsen value of the cold-rolled steel plate is 2.5 to 7.0 mm.

7. A thickness-reduced deep-draw-formed can as set forth in claim 1, wherein the surface-treated steel plate is an electrolytically chromate-treated steel plate, a hard tinplate or an aluminum-covered steel plate.

8. A thickness-reduced deep-draw-formed can as set forth in claim 1, wherein the surface-treated steel plate comprises a hard tin plate having a deposited tin amount of 0.5 to 11.2 g/m$^2$ and has been subjected to a chromate treatment or a chromate/phosphate treatment so that the amount of chromium deposited is 1 to 30 mg/m$^2$ in terms of metallic chromium.

9. A thickness-reduced deep-draw-formed can as set forth in claim 1, wherein the surface-treated steel plate is an aluminum-covered steel plate.

10. A thickness-reduced deep-draw-formed can as set forth in claim 1, wherein the surface-treated steel plate is an electrolytically chromate-treated steel plate.

11. A thickness-reduced deep-draw-formed can as set forth in claim 10, wherein the electrolytically chromate-treated steel plate comprises 10 to 200 mg/m$^2$ of a metallic chromium layer and 1 to 50 mg/m$^2$ of a chromium oxide layer in terms of metallic chromium.

12. A thickness-reduced deep-draw-formed can as set forth in claim 6, wherein the Erichsen value of the cold-rolled steel plate is 3.0 to 6.0 mm.

* * * * *